US010545005B2

(12) United States Patent
Bender

(10) Patent No.: US 10,545,005 B2
(45) Date of Patent: Jan. 28, 2020

(54) FIREARM DELAY MECHANISM

(71) Applicant: In Ovation LLC, Vadnais Heights, MN (US)

(72) Inventor: Terrence Dwight Bender, Minneapolis, MN (US)

(73) Assignee: In Ovation LLC, Vadnais Heights, MN (US)

( * ) Notice: Subject to any disclaimer, the term of this patent is extended or adjusted under 35 U.S.C. 154(b) by 0 days.

(21) Appl. No.: 15/923,341

(22) Filed: Mar. 16, 2018

(65) Prior Publication Data

US 2018/0266782 A1 Sep. 20, 2018

Related U.S. Application Data

(60) Provisional application No. 62/472,043, filed on Mar. 16, 2017.

(51) Int. Cl.

| | |
|---|---|
| ***F41A 19/03*** | (2006.01) |
| ***F41A 19/14*** | (2006.01) |
| ***F41A 19/31*** | (2006.01) |
| ***F41A 3/56*** | (2006.01) |

(52) U.S. Cl.

CPC ..... *F41A 19/03* (2013.01); *F41A 3/56* (2013.01); *F41A 19/14* (2013.01); *F41A 19/31* (2013.01)

(58) Field of Classification Search

CPC ..... F41A 19/03; F41A 19/14; F41A 19/31; F41A 3/56; F41A 3/54; F41A 3/36; F41A 3/40; F41A 3/38; F41A 3/44; F41A 3/46; F41A 3/14; F41A 3/26; F41A 3/28

USPC ..... 89/129.01, 127, 128, 129.02, 132

See application file for complete search history.

(56) References Cited

U.S. PATENT DOCUMENTS

| | | | | |
|---|---|---|---|---|
| 4,461,203 | A * | 7/1984 | Jawdat | F41A 3/46 89/154 |
| 4,930,399 | A * | 6/1990 | Trevor, Jr. | F41A 3/46 89/185 |
| 2012/0180354 | A1* | 7/2012 | Sullivan | F41A 3/26 42/16 |
| 2013/0118343 | A1* | 5/2013 | Hirt | F41A 19/06 89/149 |
| 2014/0102287 | A1* | 4/2014 | Jebsen | F41A 3/56 89/24 |
| 2015/0338178 | A1* | 11/2015 | Neitzling | F41A 3/26 89/191.01 |
| 2016/0370135 | A1* | 12/2016 | Plumb | F41A 3/78 |
| 2017/0115078 | A1* | 4/2017 | Plumb | F41A 3/26 |
| 2017/0299323 | A1* | 10/2017 | Nachefski | F41A 17/56 |
| 2018/0080732 | A1* | 3/2018 | Brown | F41A 19/45 |

* cited by examiner

*Primary Examiner* — John Cooper

(74) *Attorney, Agent, or Firm* — Vidas, Arrett & Steinkraus

(57) ABSTRACT

In some embodiments, a firearm comprises a lower receiver, a bolt carrier and a weight. The lower receiver is arranged to support a hammer and an auto-sear. The bolt carrier comprises a body and a striker moveable with respect to the body between a first position and a second position. The body defines a first cavity adjacent the striker. A weight is positioned in the first cavity and arranged to move the striker to the second position, wherein the striker is arranged to operate the auto-sear.

20 Claims, 7 Drawing Sheets

FIREARM DELAY MECHANISM

CROSS-REFERENCE TO RELATED APPLICATIONS

This application claims the benefit of U.S. patent application Ser. No. 62/472,043, filed Mar. 16, 2017, the entire content of which is hereby incorporated herein by reference.

BACKGROUND OF THE INVENTION

This invention relates to automatic machine guns and fire control mechanisms.

Automatic repeating firearms generally have high firing rates. For example, M4 and M16 machine guns can fire 700-900 or more rounds per minute. While a high firing rate has certain benefits, there can be drawbacks such as decreased accuracy and increased ammunition consumption.

There remains a need for firearm mechanisms having variable rates of fire. There remains a need for novel firearm mechanisms. There remains a need for mechanisms that can slow the firing rate of available automatic firearms.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a firearm mechanism comprises a hammer, an auto-sear and a bolt carrier. The bolt carrier comprises a body and a striker moveable with respect to the body between a first position and a second position. The striker is biased to the first position by a biasing mechanism. The striker does not contact the auto-sear in the first position. The striker contacts the auto-sear in the second position and is arranged to operate the auto-sear in the second position.

In some embodiments, the firearm mechanism comprises a reciprocating weight arranged to move the striker to the second position. Desirably, the weight is moveable with respect to the bolt carrier and arranged to operate the auto-sear.

In some embodiments, the firearm mechanism comprises a buffer comprising a buffer cavity, the weight arranged to travel into the buffer cavity.

In some embodiments, a firearm comprises a lower receiver, a bolt carrier and a weight. The lower receiver is arranged to support a hammer and an auto-sear. The bolt carrier comprises a body and a striker moveable with respect to the body between a first position and a second position. The body defines a first cavity adjacent the striker. A weight is positioned in the first cavity and arranged to move the striker to the second position, wherein the striker is arranged to operate the auto-sear.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
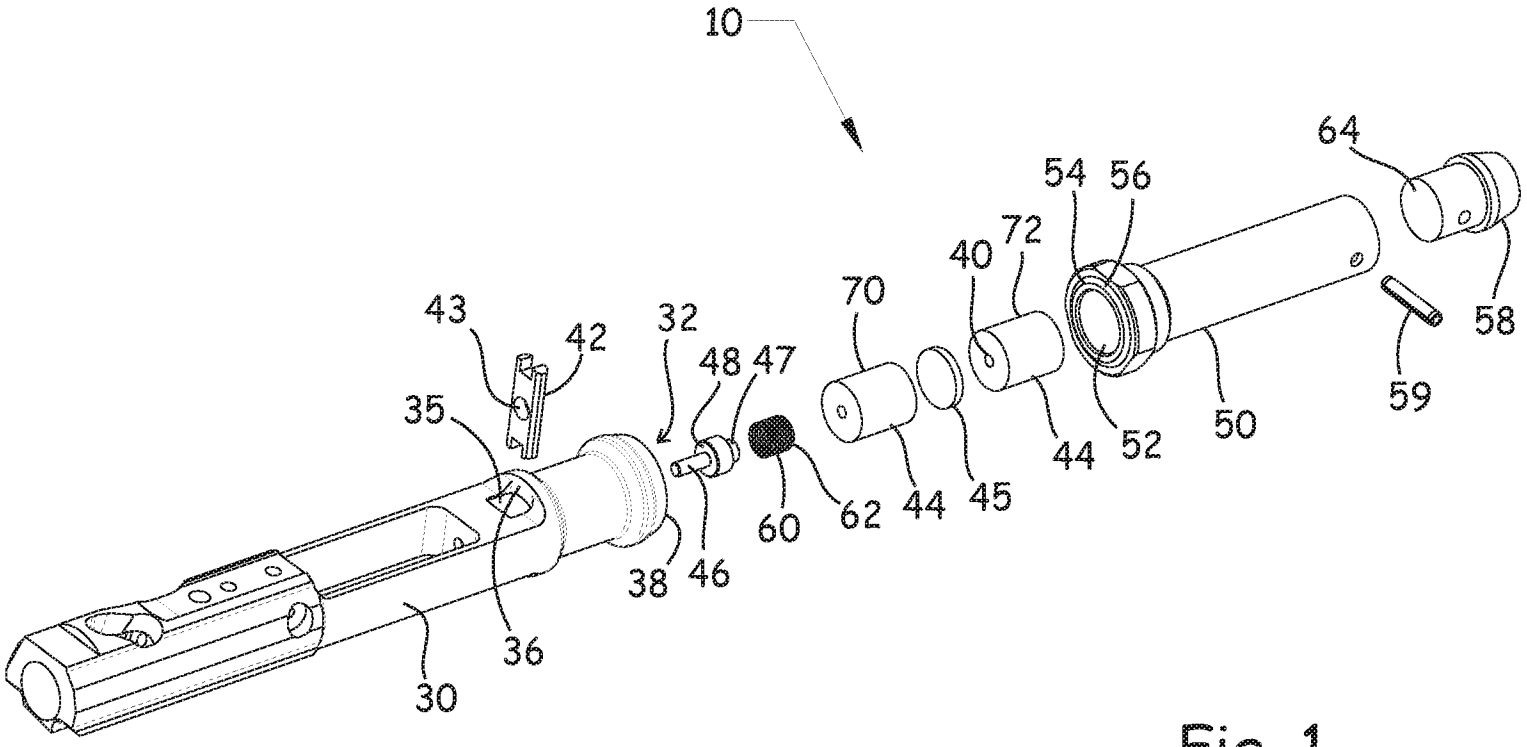
FIG. 1 shows an exploded view of an embodiment of a firearm delay mechanism.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of components that can be used in a firearm delay mechanism 10. In some embodiments, the parts of the firearm delay mechanism 10 are suitable for use in standard M4 and M16 firearms as drop-in replacement parts, without requiring any change to other parts of the firearm.

In some embodiments, a firearm delay mechanism 10 comprises a bolt carrier 30, a striker 42, at least one weight 44 and a buffer 50. In some embodiments, the striker 42 is carried by the bolt carrier 30. In some embodiments, the weight 44 is arranged to contact and move the striker 42, and the striker 42 can be arranged to operate an auto-sear of a firearm. In some embodiments, the buffer 50 comprises a cavity 52, and the weight(s) 44 can be oriented in the cavity 52.

Figure 2:
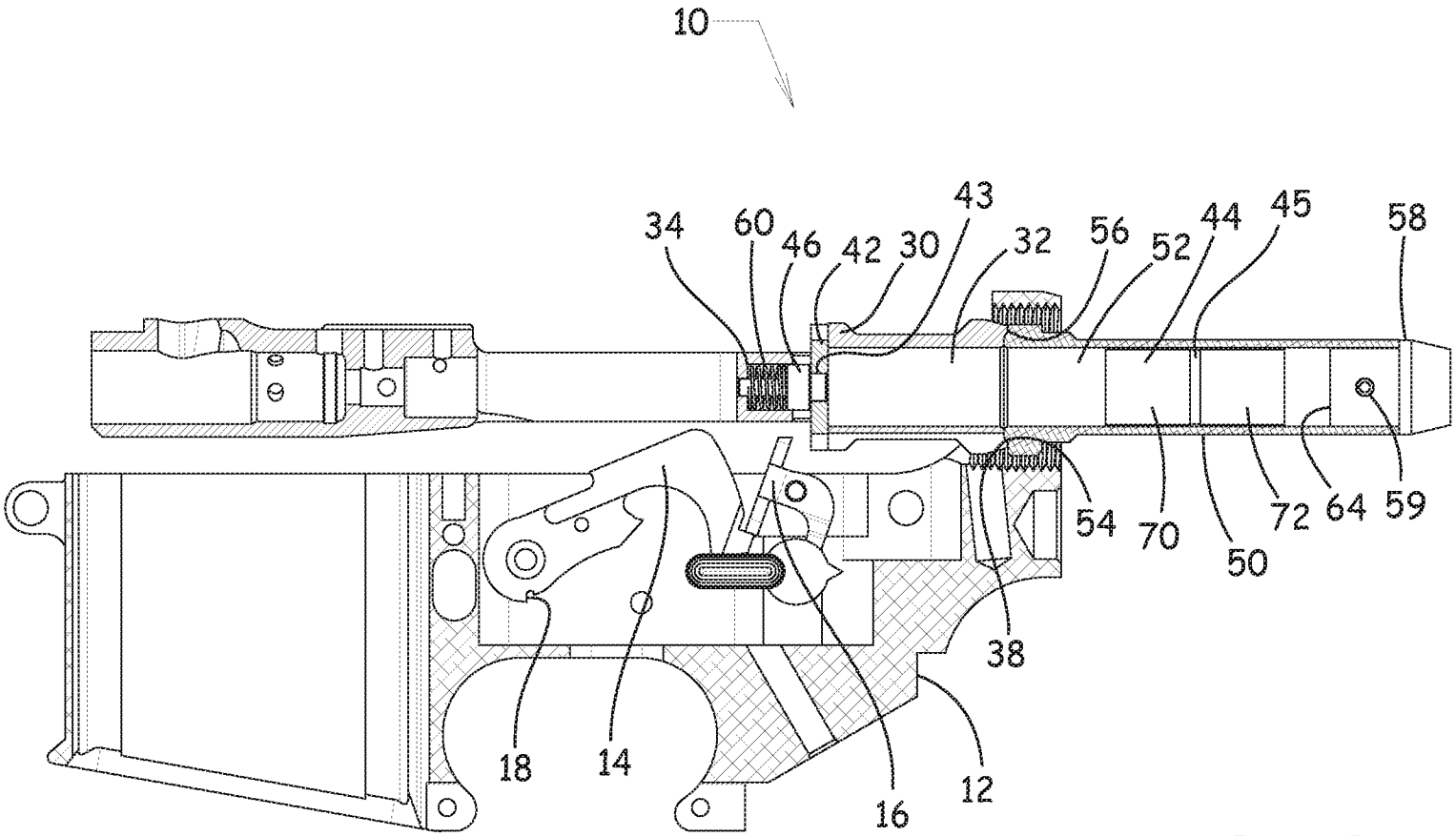
FIG. 2 shows a cross-sectional view of a portion of a firearm comprising an embodiment of a delay mechanism.

FIG. 2 shows an embodiment of a firearm delay mechanism 10 positioned with respect to an embodiment of a lower receiver 12. In some embodiments, the lower receiver 12 comprises a standard military specification M4 or M16 lower receiver. In some embodiments, a lower receiver 12 comprises a hammer 14 and an auto-sear 16. In some embodiments, the hammer 14 comprises a sear 18 arranged to contact the sear of a finger trigger (not illustrated). In some embodiments, the hammer 14 and auto-sear 16 comprise standard military specification parts.

In some embodiments, the striker 42 is moveable with respect to the bolt carrier 30 between first and second positions. In some embodiments, the striker 42 is biased to the first position by a biasing mechanism 60. In some embodiments, when the striker 42 is in its second position and the bolt carrier 30 is properly oriented with respect to the lower receiver 12, the striker 42 will operate the auto-sear 16 and fire a round.

With reference to FIGS. 1 and 2, in some embodiments, the bolt carrier 30 comprises a cavity 32. In some embodiments, the cavity 32 is open to the rear end 38 of the bolt carrier 30. In some embodiments, the cavity 32 of the bolt carrier 30 is aligned with the cavity 52 of the buffer 50. In some embodiments, at least a portion of the weight 44 is arranged to travel between the cavity 52 of the buffer 50 and the cavity 32 of the bolt carrier 30.

In various embodiments, the weight 44 can have any suitable size, shape and configuration. A weight 44 having a shorter length can take more time to traverse the path from a rear of the buffer cavity 52 to the striker 42 than a weight 44 having a longer length. A weight 44 or assembly of weights 44 can occupy any suitable length portion of the buffer cavity 52 and/or the bolt carrier cavity 32. Weights 44 of different sizes can be used to adjust the specific timing delay of the delay mechanism 10.

A weight 44 can comprise any suitable material or combination of materials, such as metals, polymers, composite materials, etc. In some embodiments, a weight 44 comprises aluminum. In some embodiments, a weight 44 comprises steel. In some embodiments, a weight 44 comprises tungsten. Varying the mass of a weight 44 can change the time delay provided by the delay mechanism 10.

In some embodiments, a weight 44 is free-floating and free to move in response to applied forces.

In some embodiments, a weight 44 comprises an assembly having a plurality of weight portions 70, 72. Any suitable number of weight portions 70, 72 can be used, and weight portions 70, 72 can be similar to one another or different in size, shape, material, etc. In some embodiments, a weight 44 comprises one or more spacers 45, which can be used between adjacent weight portions 70, 72. In some embodiments, a spacer 45 comprises a bumper. In some embodiments, a spacer 45 comprises a polymeric or elastomeric material. In some embodiments, a spacer 45 is attached to one or more of the weight portions 70, 72. For example, in some embodiments, a spacer 45 comprises a stem 41 arranged to engage a cavity 40 formed in a weight portion 70, 72.

In some embodiments, the rear end 38 of the bolt carrier 30 and the front end 54 of the buffer 50 are arranged to engage one another and self-align. In some embodiments, the front end 54 of the buffer 50 comprises an inclined surface, peak or frustoconical surface 56 arranged to engage a complimentary shaped declined surface, valley or inverse frustoconical surface of the rear end 38 of the bolt carrier 30. The complimentary shaped ends 38, 54 desirably encourage the bolt carrier 30 and buffer 50 to align such that a central axis of the cavity 32 of the bolt carrier 30 is coaxial with a central axis of the cavity 52 of the buffer 50.

In some embodiments, the rear end 38 of the bolt carrier 30 is chamfered. In some embodiments, the front end 52 of the buffer 50 is chamfered. Chamfers can help the weight(s) 44 to pass smoothly across the transition between the bolt carrier cavity 32 and the buffer cavity 52.

In some embodiments, the buffer 50 comprises a bumper 58. In some embodiments, the bumper 58 is attached to the buffer 50 with a pin 59. In some embodiments, the bumper 58 comprises a contacting surface 64 arranged to contact the weight 44.

In some embodiments, the striker 42 is positioned at an end of the bolt carrier cavity 32, and the weight 44 can contact the striker 42.

In some embodiments, the bolt carrier 30 comprises a cavity 34 and a slot 35 arranged to support striker components. In some embodiments, a striker pin 46 is received in the cavity 34 and arranged to engage the striker 42. In some embodiments, an engaging portion 47 of the striker pin 46 is received in an aperture 43 in the striker 42.

In some embodiments, the biasing mechanism 60 comprises a coil spring 62 extending around the striker pin 46. In some embodiments, the striker pin 46 comprises a flange 48 arranged to engage the biasing mechanism 60. In some embodiments, the biasing mechanism 60 and striker pin 46 can be installed in the cavity 34, the biasing mechanism 60 can be compressed, and the striker 42 installed in the slot 35, wherein the engaging portion 47 of the striker pin 46 can engage the striker 42. The biasing mechanism 60 and striker pin 46 can bias the striker 42 against a flange 36 of the bolt carrier 30. In some embodiments, the striker 42 abuts the flange 36 when the striker 42 is in the first position with respect to the bolt carrier 30.

Figure 3:
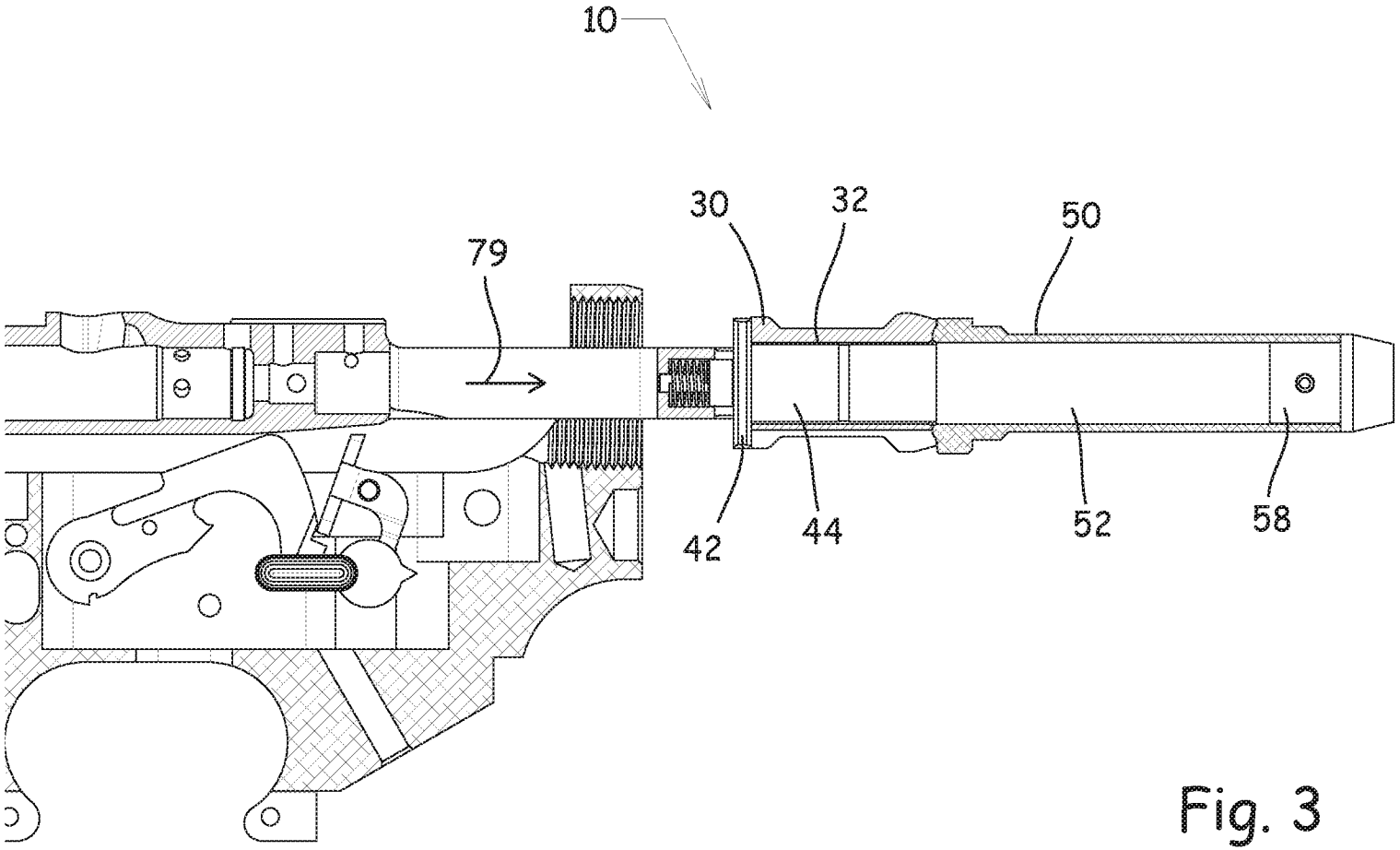
FIGS. 3-7 show the operation of an embodiment of a delay mechanism during a firing sequence.

FIG. 3 illustrates an embodiment of a delay mechanism 10 at a point in time after a first round has been fired. The bolt carrier 30 and buffer 50 are traveling in the rearward direction 79, for example under the force of expanding gasses from the first round. The weight(s) 44 are free to move within the cavities 32, 52. As the bolt carrier 30 moves in the rearward direction 79, the weight(s) 44 reach a forward end of the bolt carrier cavity 32, for example contacting the striker 42, and then move in the rearward direction 79 along with the bolt carrier 30.

As the bolt carrier 30 and buffer 50 reach the end of their rearward travel, they will decelerate and stop, for example under the force of a recoil spring (not illustrated). During deceleration, the weight(s) 44 will continue traveling in the rearward direction 79 and will move with respect to the cavities 32, 52. In some embodiments, the weight(s) 44 will exit the bolt carrier cavity 32 and move entirely into the buffer cavity 52. In some embodiments, the weight(s) 44 will travel until stopping at the rear of the buffer cavity 52, for example with a rearmost weight 44 contacting the bumper 58.

Figure 4:
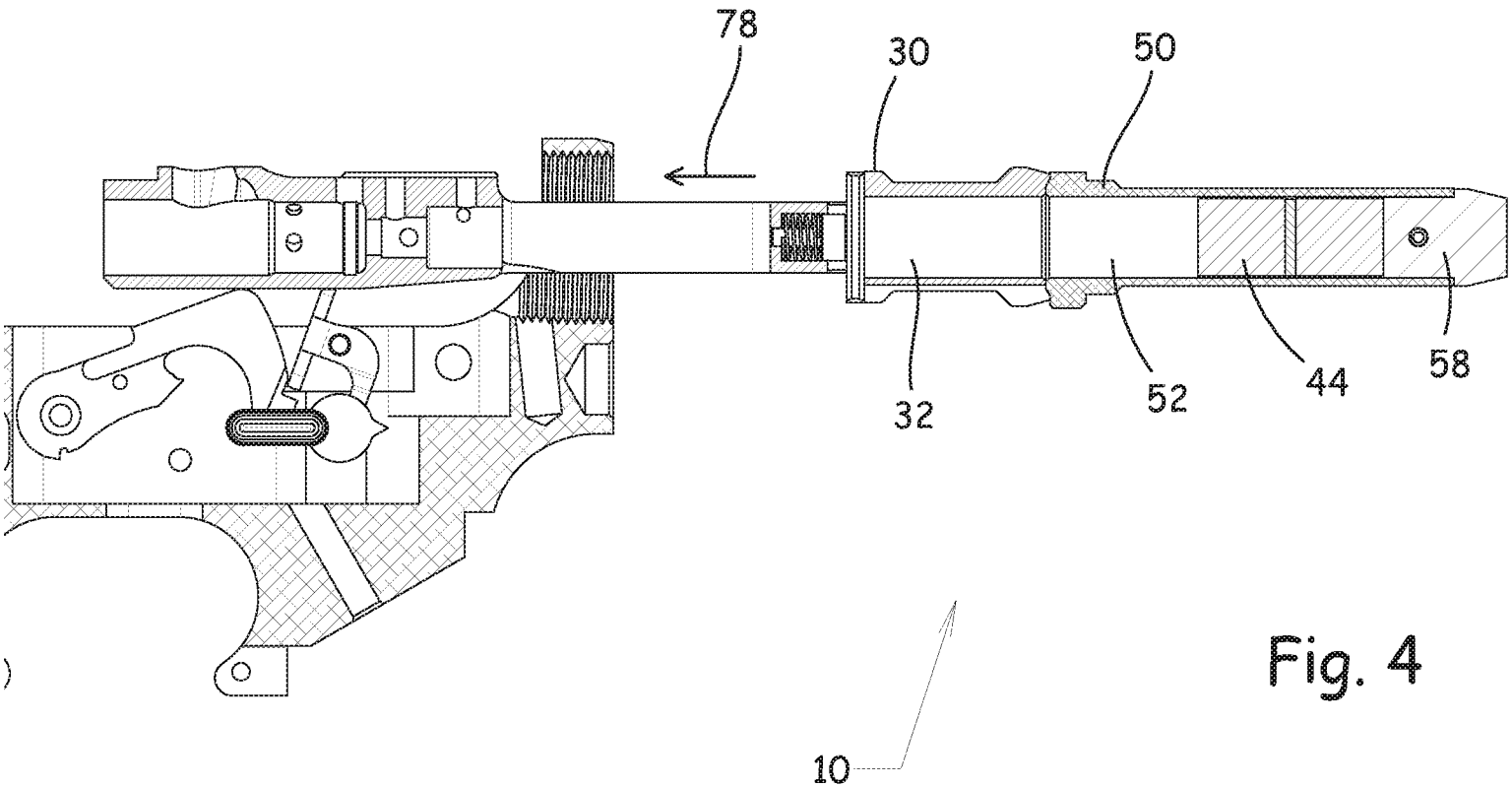

FIG. 4 shows the weight(s) 44 stopped against the bumper 58. The bolt carrier 30 and buffer 50 are being moved in the forward direction 78, for example under the force of a recoil spring (not illustrated). The bolt carrier 30 and buffer 50 will typically move forward until reaching their forward stop positions.

Figure 5:
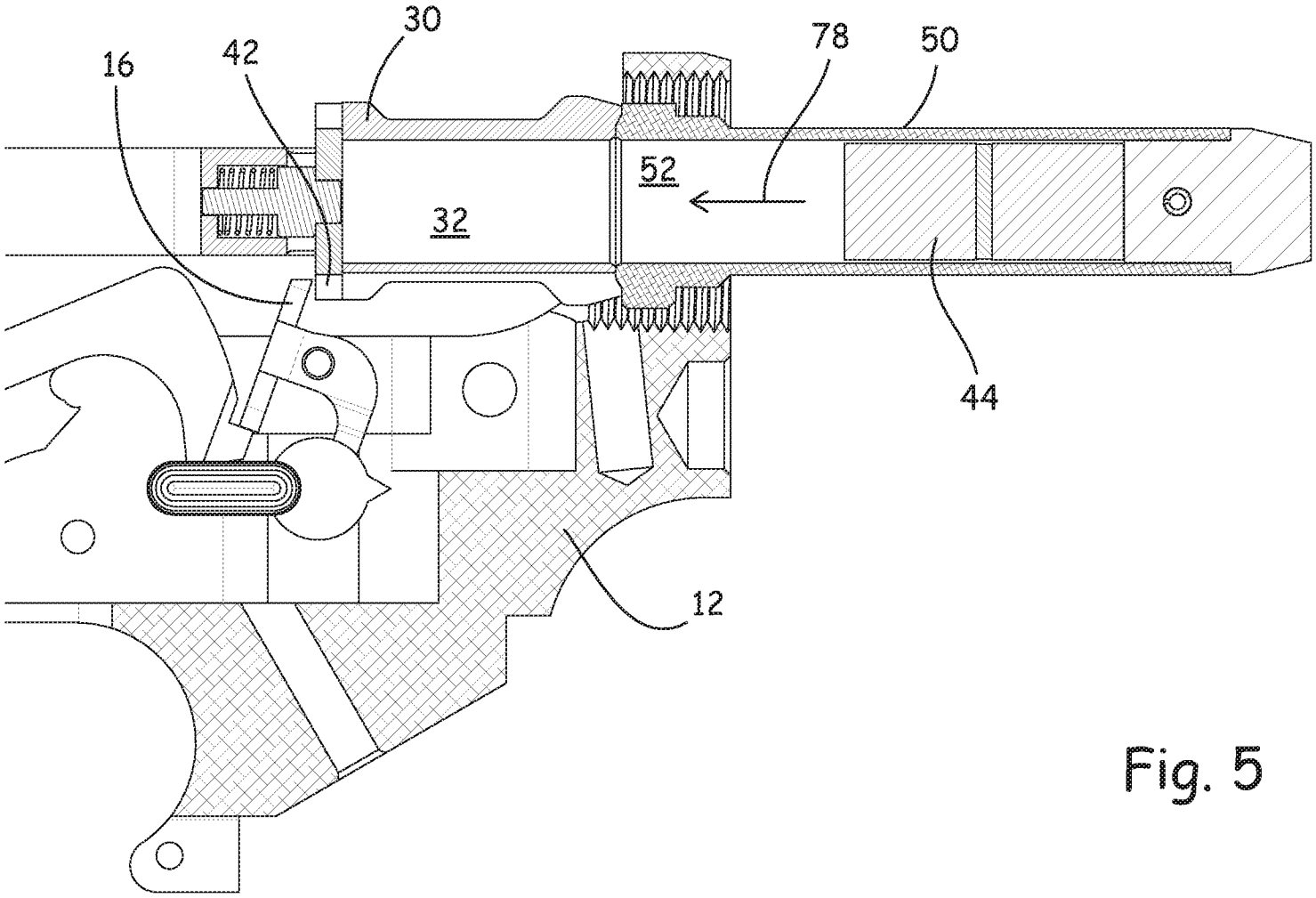

FIG. 5 shows the bolt carrier 30 and buffer 50 reaching their forward positions with respect to the lower receiver 12, a time when a standard mil-spec M16 may fire a second round; however, the delay mechanism 10 does not yet fire. Due to positioning of the bolt carrier 30, the striker 42 is positioned near the auto-sear 16 but does not contact the auto-sear 16. The striker 42 remains biased to its first position with respect to the bolt carrier 30 by the biasing mechanism 60. The weight(s) 44 are still shown near the rear of the buffer cavity 52 but have begun traveling forward 78 in the buffer cavity 52.

Figure 6:
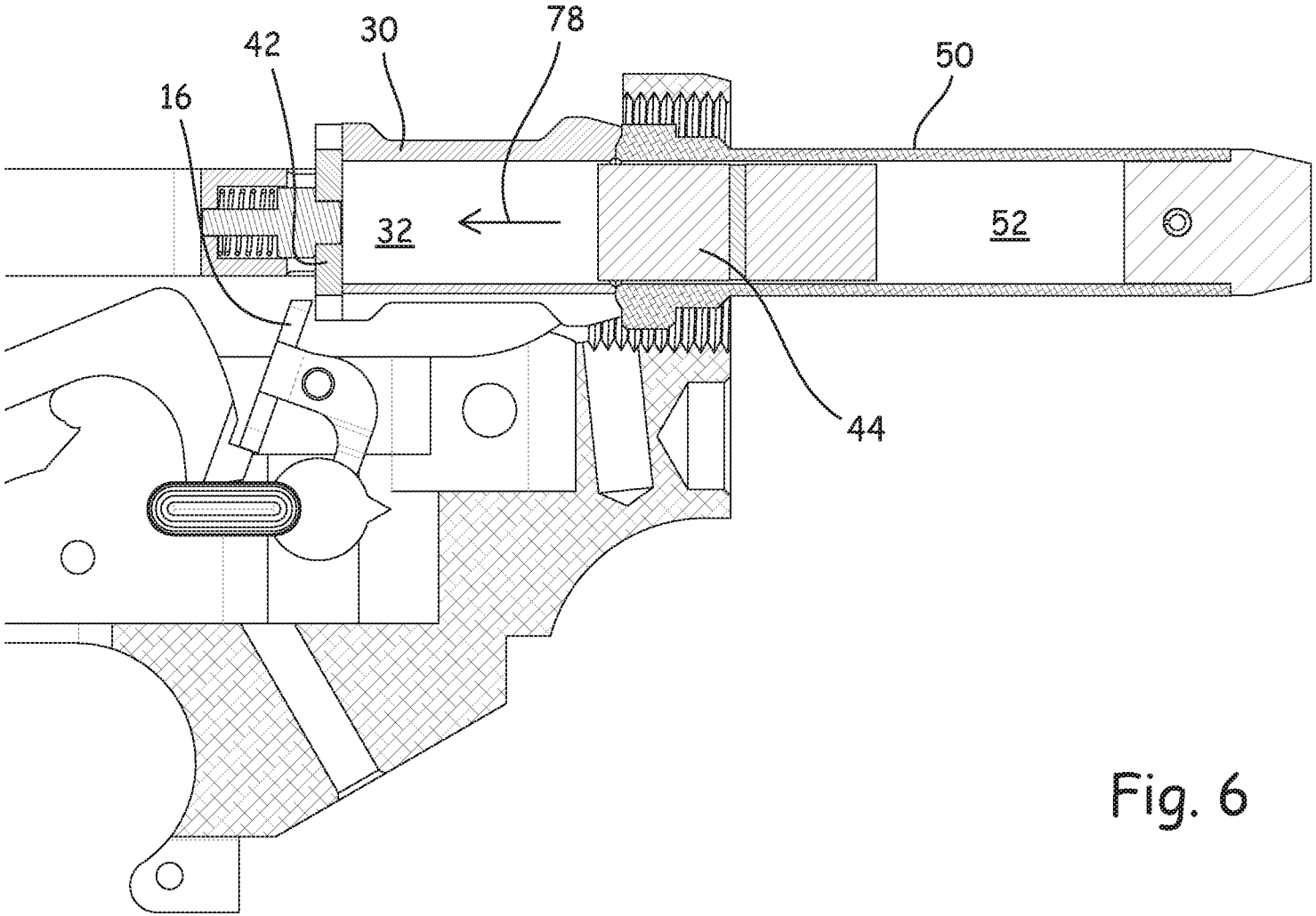

FIG. 6 shows the weight(s) 44 traveling forward 78 in the cavities 32, 52. In some embodiments, the weight(s) 44 will pass entirely into the buffer cavity 32.

Figure 7:
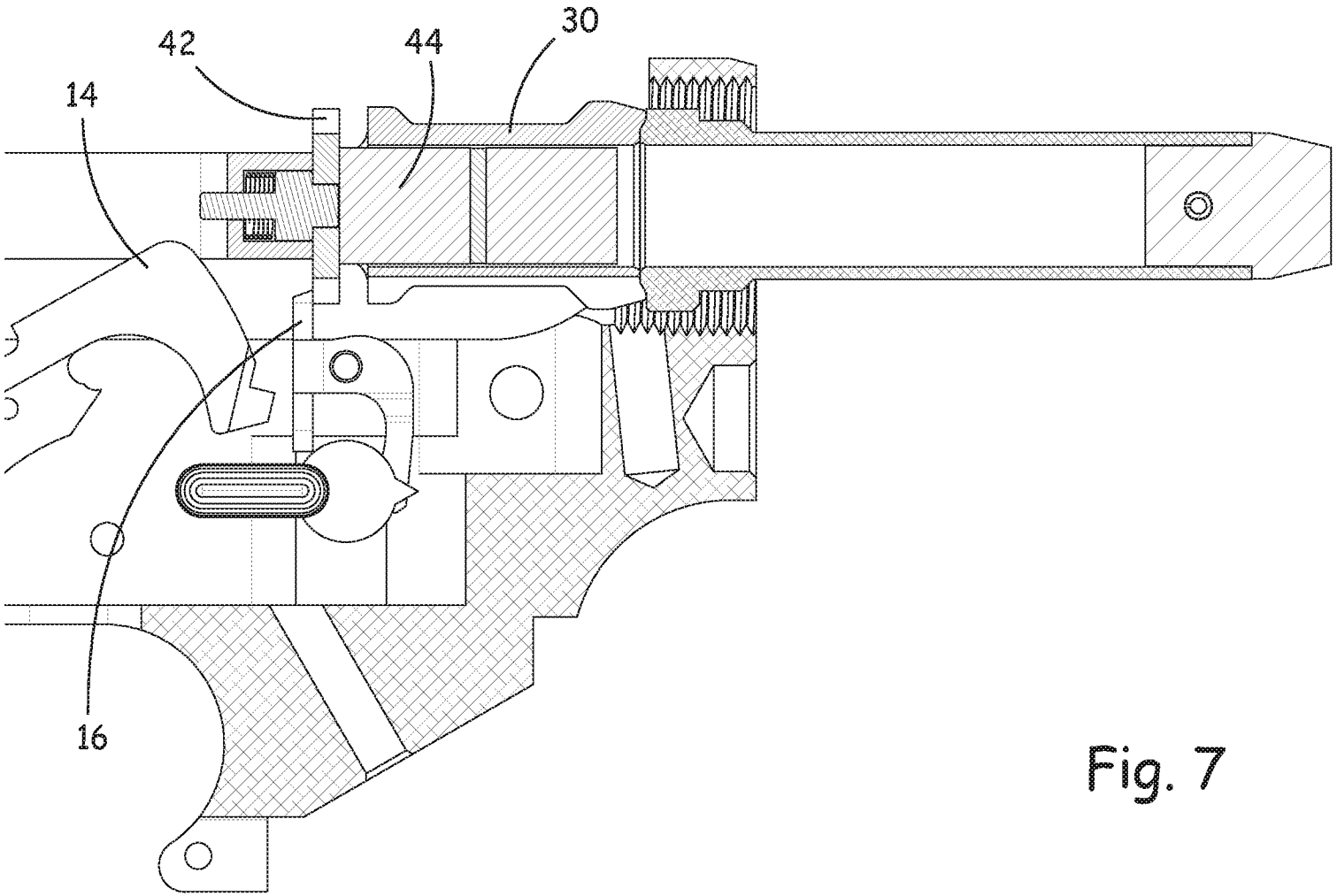

FIG. 7 shows the weight(s) 44 impacting the striker 42 and operating the striker 42, moving the striker 42 to its second position with respect to the bolt carrier 30. In the second position, the striker 42 contacts and operates the auto-sear 16, releasing the hammer 14 and firing another round.

A firearm comprising a delay mechanism 10 can fire more slowly in a fully automatic firing mode than a traditional version of the firearm. The travel of the weight(s) 44 provides a time delay in the cycling rate, and different embodiments of weight(s) 44 can provide different adjustments in cycle rate. In some embodiments, the size and physical dimensions of a weight 44 can be adjusted to vary the cycle rate. Different numbers of weights 44 can be used to vary the cycle rate. Different materials and weights 44 having different masses can be used to vary the cycle rate. In some embodiments, substituting a buffer 50 having a different size, which can provide a buffer cavity 52 having a different length, can adjust the cycle rate. In some embodiments, changing a length of a bumper 58 can change the length of the buffer cavity 52 and can adjust the cycle rate.

In some embodiments, the weight(s) 44 deliver energy to the bolt carrier 30 upon impact with the striker 42, for example placing an impact force on the bolt carrier 30 in the forward direction 78. In some embodiments, the weight(s) 44 can drive the bolt carrier assembly into battery, for example in the event that the bolt carrier assembly does not fully assume its configuration in battery under force from a recoil spring. Thus, in some embodiments, the weight(s) 44 can be arranged to perform all functions of traditional buffer weights.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A firearm mechanism comprising:

a hammer;

an auto-sear;

a bolt carrier comprising a body and a striker moveable with respect to the body between a first position and a second position, the striker biased to the first position by a biasing mechanism; and a reciprocating weight;

the striker not contacting the auto-sear in the first position, the striker contacting the auto-sear in the second position, the reciprocating weight arranged to move the striker to the second position.

2. The firearm mechanism of claim 1, comprising a buffer adjacent to the bolt carrier, the buffer comprising a buffer cavity, the reciprocating weight arranged to move in the buffer cavity.

3. The firearm mechanism of claim 1, comprising a pin supported by the bolt carrier, the striker comprising an aperture, a portion of the pin oriented in the aperture.

4. The firearm mechanism of claim 3, the biasing mechanism comprising a spring arranged to contact the pin.

5. The firearm mechanism of claim 1, the bolt carrier body defining a cavity adjacent to the striker.

6. The firearm mechanism of claim 5, the striker comprising a wall portion of the cavity.

7. A firearm mechanism comprising:

a hammer;

an auto-sear;

a bolt carrier comprising a body and a striker moveable with respect to the body between a first position and a second position, the striker biased to the first position by a biasing mechanism, the body defining a cavity adjacent to the striker; and a weight moveable with respect to the bolt carrier;

the striker not contacting the auto-sear in the first position, the striker contacting the auto-sear in the second position the weight arranged to operate the auto-sear.

8. The firearm mechanism of claim 7, comprising a buffer adjacent to the bolt carrier, the buffer comprising a buffer cavity, the firearm mechanism comprising an orientation wherein the weight is in the buffer cavity.

9. The firearm mechanism of claim 8, wherein the weight travels between the cavity and the buffer cavity during a firing cycle.

10. The firearm mechanism of claim 8, wherein surfaces of the bolt carrier and buffer that contact one another comprise complimentary shapes arranged to self-align the bolt carrier and buffer on a common axis.

11. The firearm mechanism of claim 8, wherein one of the bolt carrier and buffer comprises an inclined surface, and the other of the bolt carrier and buffer comprises a declined surface, the inclined surface arranged to contact the declined surface.

12. The firearm mechanism of claim 11, wherein the inclined surface contacts the declined surface when a central axis of the bolt carrier and a central axis of the buffer are coaxial.

13. The firearm mechanism of claim 8, the buffer comprising a front aperture and a rear bumper.

14. A firearm comprising:

a lower receiver arranged to support a hammer and an auto-sear;

a bolt carrier comprising a body and a striker moveable with respect to the body between a first position and a second position, the body defining a first cavity adjacent the striker;

a weight positioned in the first cavity, the weight arranged to move the striker to the second position, the striker arranged to operate the auto-sear in the second position.

15. The firearm of claim 14, the striker biased to the first position by a biasing mechanism.

16. The firearm of claim 14, comprising a buffer adjacent to the bolt carrier, the buffer comprising a second cavity, the weight arranged to travel between the first cavity and the second cavity.

17. The firearm of claim 16, the bolt carrier comprising an opening into the first cavity and the buffer comprising an opening into the second cavity.

18. The firearm of claim 16, wherein contacting surfaces of the buffer and the bolt carrier comprise complimentary shapes arranged to self-align.

19. The firearm of claim 16, wherein a rear end of the bolt carrier is chamfered.

20. The firearm of claim 19, wherein a front end of the buffer is chamfered.

* * * * *